US008037923B2

(12) United States Patent
Alkhoury et al.

(10) Patent No.: US 8,037,923 B2
(45) Date of Patent: Oct. 18, 2011

(54) MAGNETICALLY ATTACHABLE WINDOW SCREEN SYSTEM

(76) Inventors: Boulos Paul Alkhoury, Mount Albert (CA); Pasqualino D'uva, Kleinberg (CA)

( * ) Notice: Subject to any disclaimer, the term of this patent is extended or adjusted under 35 U.S.C. 154(b) by 476 days.

(21) Appl. No.: 12/071,402

(22) Filed: Feb. 20, 2008

(65) Prior Publication Data

US 2009/0183844 A1 Jul. 23, 2009

(51) Int. Cl.
*E06B 9/52* (2006.01)

(52) U.S. Cl. ..... 160/369; 160/DIG. 16

(58) Field of Classification Search ..... 160/369, 160/371, 90, DIG. 16; 52/202, 203, DIG. 4
See application file for complete search history.

(56) References Cited

U.S. PATENT DOCUMENTS

| | | | | |
|---|---|---|---|---|
| 1,779,636 | A * | 10/1930 | Pendery | 160/369 |
| 1,920,614 | A * | 8/1933 | Ware | 160/90 |
| 2,898,991 | A * | 8/1959 | Kelly et al. | 160/369 |
| 3,021,895 | A * | 2/1962 | Mendelsohn | 160/90 |
| 3,121,922 | A * | 2/1964 | Niese | 49/63 |
| 3,170,507 | A * | 2/1965 | Kleinknecht | 160/369 |
| 3,679,505 | A | 7/1972 | Hinderaker et al. | |
| 3,805,872 | A | 4/1974 | Lorber | |
| 4,079,558 | A * | 3/1978 | Gorham | 52/202 |
| 4,387,541 | A * | 6/1983 | Boomershine | 52/202 |
| 4,409,758 | A * | 10/1983 | Dickerson et al. | 49/463 |
| 4,561,223 | A * | 12/1985 | Gold et al. | 52/202 |
| 4,592,180 | A * | 6/1986 | Gerritsen | 52/203 |
| 4,656,778 | A * | 4/1987 | Fiorenza, Sr. | 49/63 |
| 4,802,523 | A | 2/1989 | Scholten et al. | |
| 5,020,293 | A * | 6/1991 | Itagaki | 52/314 |
| 5,687,506 | A | 11/1997 | Davies et al. | |
| 5,806,256 | A * | 9/1998 | Byrne | 52/204.5 |
| 5,911,266 | A | 6/1999 | Jacobs | |
| 5,946,857 | A | 9/1999 | Davies et al. | |
| 6,073,675 | A * | 6/2000 | Dannaher | 160/369 |
| 6,209,610 | B1 | 4/2001 | Davies et al. | |
| 6,257,307 | B1 | 7/2001 | Tollivar | |
| 6,267,168 | B1 | 7/2001 | Davies et al. | |
| 6,405,781 | B2 | 6/2002 | Davies et al. | |
| 6,446,696 | B1 | 9/2002 | Davies et al. | |
| D484,991 | S | 1/2004 | Davies et al. | |
| 6,679,002 | B2 | 1/2004 | Davies et al. | |
| 6,691,761 | B1 | 2/2004 | Alkhoury et al. | |
| 6,701,994 | B2 | 3/2004 | Goldenberg et al. | |
| D494,401 | S | 8/2004 | Davies et al. | |
| D506,269 | S | 6/2005 | Goldenberg et al. | |
| D530,193 | S | 10/2006 | Goldenberg et al. | |
| 2007/0199259 | A1 * | 8/2007 | Parsley | 52/203 |

FOREIGN PATENT DOCUMENTS

CA 2219946 A1 4/1999

* cited by examiner

*Primary Examiner* — David Purol

(57) ABSTRACT

A magnetically attachable window screen system comprising, a rectangular casement window comprising a casement window frame for removably attaching a rectangular window screen, the casement window frame comprising four window frame sides, the four window frame sides comprising a lower horizontal frame side, an upper horizontal frame side and two opposing vertical frame sides, each window frame side comprising a front perimeter wall and a side perimeter wall, at least one frame magnet attached to the casement window frame at least partly behind the plane defining the front perimeter wall or the plane defining the side perimeter wall, at least one support on the casement window frame for supporting the window screen, the window screen comprising a screen frame comprising four screen bars, the four screen bars comprising a lower horizontal screen bar, an upper horizontal screen bar, and two vertical screen bars, the window screen further comprising at least one screen magnet attached to the window screen frame and positioned to magnetically co-operate with the at least one frame magnet attached to the casement window frame.

24 Claims, 14 Drawing Sheets

MAGNETICALLY ATTACHABLE WINDOW SCREEN SYSTEM

FIELD OF THE INVENTION

This Invention relates to a system for mounting window screens. In particular, this invention relates to a system for magnetically attaching window screens to casement windows.

BACKGROUND OF THE INVENTION

Casement windows currently used in the construction of new residential dwellings, and as an aftermarket product in renovations, typically contain a window frame of extruded plastic or the like. In order to reduce the weight of the window frame, and the cost of material, casement window frames are typically constructed with a plurality of interior walls resulting in a plurality of channels which typically run longitudinally along the entire length of each piece of straight window frame.

In order to attach a prior art window screen to a prior art casement window, the walls of the window frame against which the window screen is to be mounted are typically provided with a slot in the window frame sides bounding the sides of the window screen to be installed in the window frame. These slots typically open into an internal channel within each side of the casement window frame, the slots and underlying channels being intended to receive retaining posts mounted in the window screen. The window screen typically contains biasing means for biasing the retaining posts into the window frame through the slot and into the underlying channel.

Unfortunately the use of retaining posts is an awkward way to install and uninstall window screens from casement windows. Retaining post biasing means are typically concealed within the window screen and it is difficult to determine precisely where the retaining posts are positioned in that the position of retaining posts is typically not visible once the window screens have been installed in a casement window. When attempting to pull a window screen directly forward in an attempt to remove the window screen, the posts are often not released sufficiently by the biasing means to permit the screens to be removed without some guess work. In order to avoid any concern as to whether or not the posts or other internal parts of the window screen will be broken by forcefully pulling the window screen away from a casement window frame, a user often resorts to flexing the typical aluminum sides of the window screen at various locations in order to obtain the necessary clearance to remove the window screen without exerting excessive force. Several attempts may be required in order to determine precisely where the retaining posts are and where the window screen sides need to be flexed. Often users are unable to remove the window screens and help is sought by the user.

Although some window screens for casement windows have pull tabs, the use of such tabs is not universal due to additional cost of parts and manufacture and which tabs detract from the clean lines of the window frame sides. Although somewhat easier to use than the window screen frames without tabs, multiple retaining posts with multiple tabs are usually used, leaving the user with the frustrating task of typically pulling inwardly on two opposing tabs and then having to somehow pull inwardly on a second set of retaining tabs before the screen will be released. This often results in the user having to flex the window screen forward so the first set of tabs may be released so the user may release the seconds or subsequent set of typically opposing pull tabs. Flexing such window screens may be difficult or may damage the window screen, or at least give the user some apprehension as to whether or not the screen would be damaged using such a removal technique. Accordingly, a simpler way of attaching window screens to casement windows is desirable. Some prior art Patents have experimented with the use of magnets for holding a screen against a window aperture, such attempts have been crude and not adapted for use with casement windows. Such attempts appear to be restricted to surface mounting magnets to the window frames of older style windows. Although the magnets in some prior Patents have been hidden when window screens have been installed thereon, the magnets, or corresponding metal pieces against which magnets may operate typically remain on the frames which are unsightly when a window screen is not in position. Such unsightly appearance is completely incongruous with the clean lines of current plastic casement windows.

Accordingly, a way of minimizing or eliminating the visibility of the magnets for use with casement windows is desirable. Thus far, a way of mounting magnets within casement windows, and in particular, within one of the various channels provided by casement windows has not been invented. Furthermore, as an adequate alternative to the use of retaining posts and cooperating slots in a casement window frame has not yet been invented, it has not been possible to eliminate the retaining post slots, which not only are inconsistent with the clean lines of current day casement windows, but are also a catch all for dust, dirt, food, drink, debris and bacteria, which are almost impossible to completely clean given that the typical post slots are a passage to a typically larger channel within the casement window frame. This is especially a problem for the slot in the lower horizontal window frame member into which contaminants may fall due to the force of gravity. Regardless of the above-mentioned disadvantages relating to the use of the slot and post method of screen retention for casement windows, no adequate way of magnetically attaching window screens to casement windows has yet been invented.

BRIEF DESCRIPTION OF THE DRAWINGS

Certain embodiments of the invention are described by way of illustration only, without limiting the scope of scope of the invention set out in attached disclosure and the appended claims, reference being made to the accompanying drawings, wherein:

EXEMPLARY EMBODIMENTS OF THE INVENTION

The embodiments of the invention are described below with reference to the figures.

Figure 1:
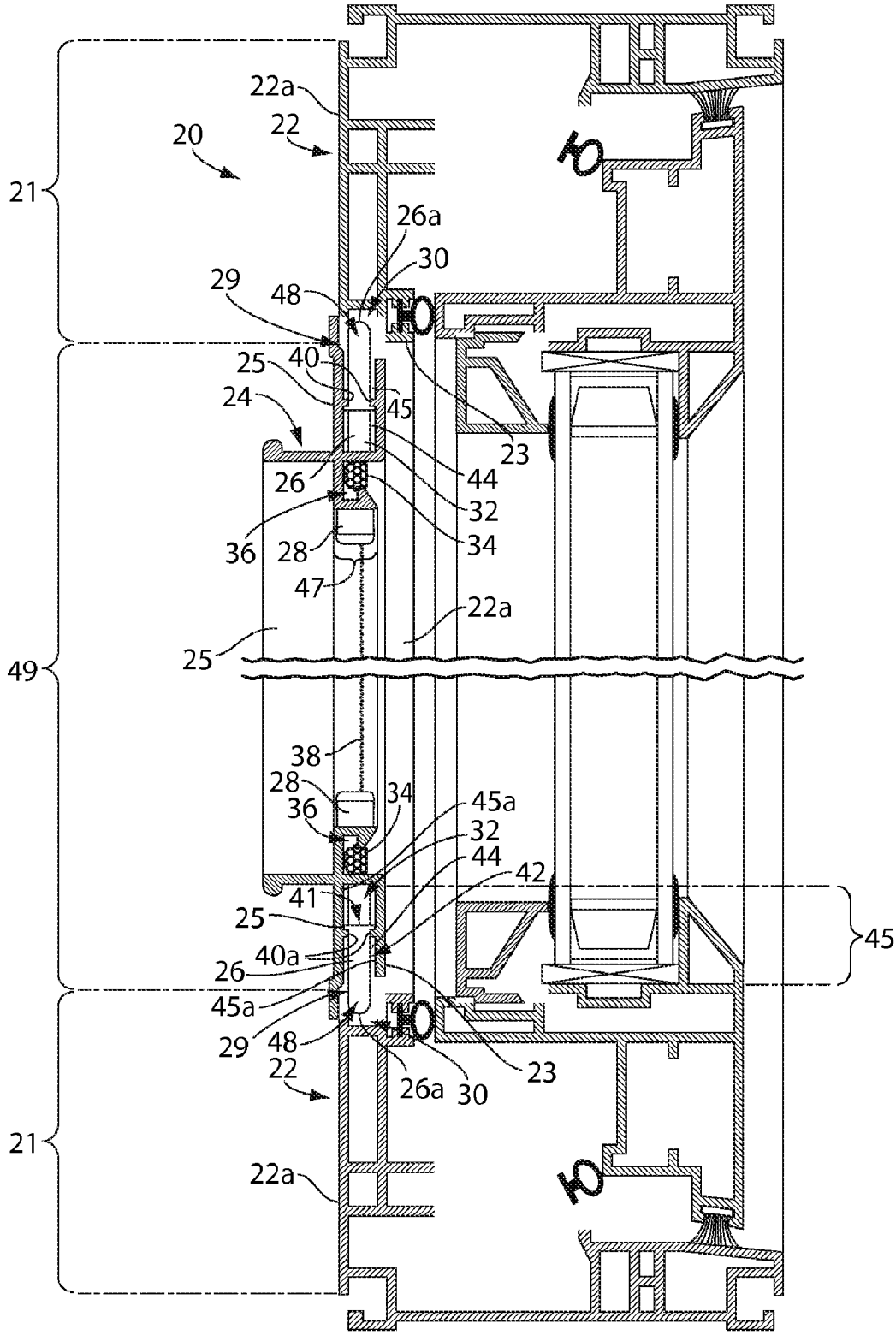
(PRIOR ART) Fig. 1
FIG. 1. is a horizontal cross sectional view of a prior art window screen attachment system with retractable posts.

FIG. 1 is a horizontal cross sectional top view of a prior art window screen attachment system with retractable posts. Rectangular casement window 20 includes a window frame 22 with four sides 22*a* each having front a perimeter wall 21 and side a perimeter wall 23. The four side perimeter walls 23 define window screen opening 49 for receiving window screen insert 47. Side perimeter walls 23 are provided with post cavity slots 48 for allowing retractable posts 26 to enter slotted post cavity 30. Slotted post cavity 30 is located within the interior of each window frame side 22*a* of window frame 22 typically directly behind front perimeter wall 21 and behind side perimeter wall 23 at frame perimeter corner 29.

Window screen 24 includes generally U shaped chamber 45 having interior chamber side walls 45*a*, each chamber side wall 45*a* comprising a retaining rib 40, opposing retaining ribs 40, being separated by retaining rib slot 41. The bottom of chamber 45 and the inside edge 40*a* of retaining rib 40 define slotted corner key cavity 32 for insertion of corner keys 44 at the ends (not shown) of intersection of horizontal and vertical screen bars 25 for forming the four perpendicular corners (not shown) of window screen 24. Chamber 45 also includes post passage 42 which allows retractable posts 26 to be withdrawn from slotted post cavities 30 through post cavity slot 48. Pull tabs 28 are sometimes connected to the retractable posts 26 through an aperture (not shown) in the bottom of chamber 45. Retractable posts 26 typically co-operate with biasing means (not shown) typically mounted in slotted corner key cavity 32 for biasing ends 26*a* of posts 26 into slotted post cavities 30. The biasing means typically a spring (not shown) only allow pull tabs 28 to be withdrawn enough to withdraw posts 26 from slotted post cavities 30 and post cavity slots 48.

As posts 26 need to pass through slotted corner key cavities 32 which cavity 32 also supports the post biasing means (not shown) in slotted corner key cavities 32, retractable posts 26 and post biasing means (not shown) must be mounted through portions of slotted corner key cavities 32 not occupied by corner keys 44.

Other prior art window screens utilize modified post s(not shown) which may have tapered or rounded ends (not shown) which allow the ends of the posts to be removed from slotted post cavities 30 by pulling window screen 24 directly away from the window frame 22 which pulling action operates against the biasing means, again typically mounted in slotted corner key cavities 32, thus avoiding the need for pull tabs 28. However, such alternate window screen retaining systems are typically difficult to operate often requiring the typical aluminum screen bars 25 to be flexed to remove the tapered or rounded ends of posts (not shown) from slotted post cavities 30. This requires care in order to ensure that posts or their cooperating parts are not broken. Further as the location of the tapered or rounded retractable posts without pull tabs 28 are typically not visible when window screen 24 is installed in window frame 22 it takes some guess work in determining where the posts are and where and if screen bars 25 need to be flexed. In any event the user is left with the concern as to whether or not the window screen 24 is being removed properly and not being damaged in the process of removal.

The prior art window screen 24 of FIG. 1 also comprise typical gasket cavities 36 for stretching screen mesh 38 between screen bars 25, which screen mesh 38 is held in place by screen gaskets 34 which are installed against screen mesh 38 in gasket cavity 36 in a conventional manner Spline may be used in place of screen gaskets as well as alternatives known in the art. Prior art screen frame 24 of FIG. 1 is typically constructed of screen bars 25 of the same profile. While FIG. 1 is a horizontal sectional view showing vertical screen bars 25, a vertical sectional view of the prior art window screen attachment system of FIG. 1 would be substantially the same except that retractable posts 26 may not be required along upper or lower horizontal screen bars 25 (not shown in section). Unless the horizontal width of window screen 24 is very wide in which case horizontal screen bars 25 may bow outwardly from window frame 22, retractable posts 26 may not be needed along upper and lower horizontal screen bars 25. Typically in smaller windows only horizontally retractable posts 26 are utilized, typically with two retractable posts 26 along each opposing vertical screen bar 25. Pull tabs 28 are typically mounted horizontally opposing each other along vertical screen bars 25 for pulling both of said opposing pull tabs 28 inwardly at the same time by a user using both hands.

Figure 2:
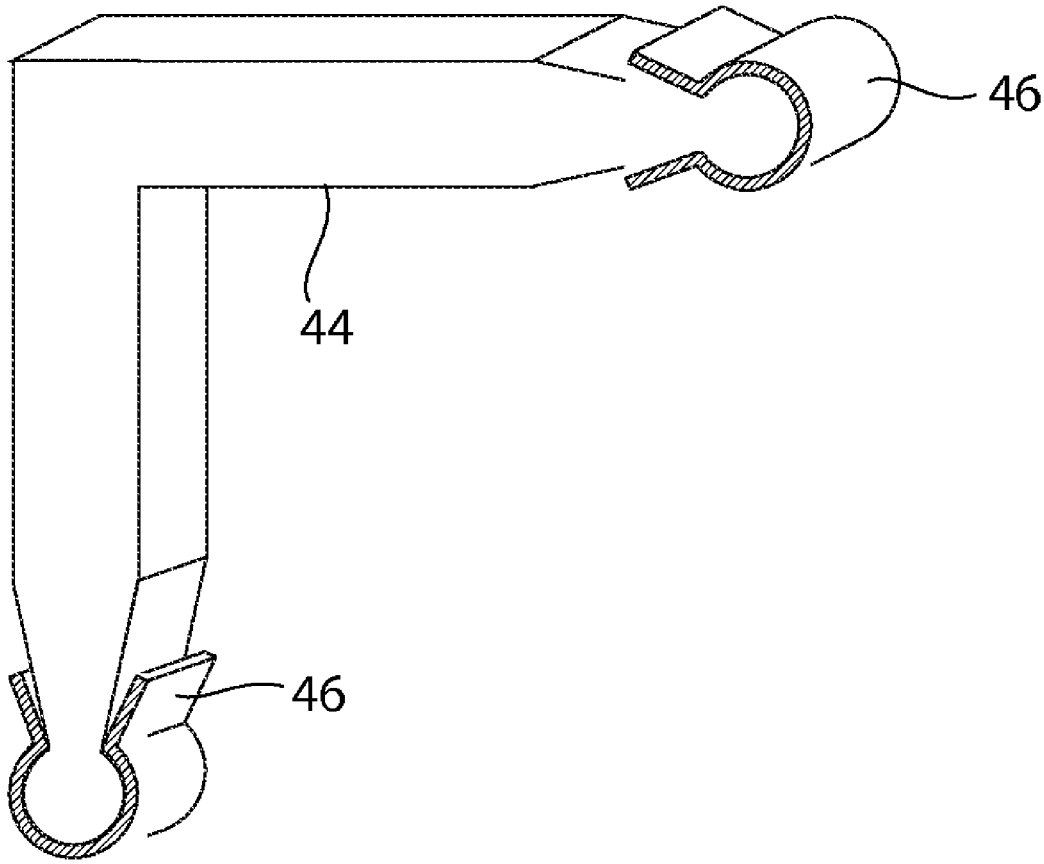
(PRIOR ART) Fig. 2
FIG. 2 is a perspective view of a coiner key with spring retaining clip.

FIG. 2 is a prior art typical corner key 44 with retaining clips 46. The ends of corner keys 44 with retaining clips 46 attached are typically inserted into slotted corner key cavities 32 at each of the four corners of a rectangular window screen frame (not shown). The ends (not shown) of screen bars 25 of a typical rectangular window screen 24 have ends (not shown) typically cut at a forty-five degree angle for mating adjoining screen bars 25 perpendicularly.

Figure 3:
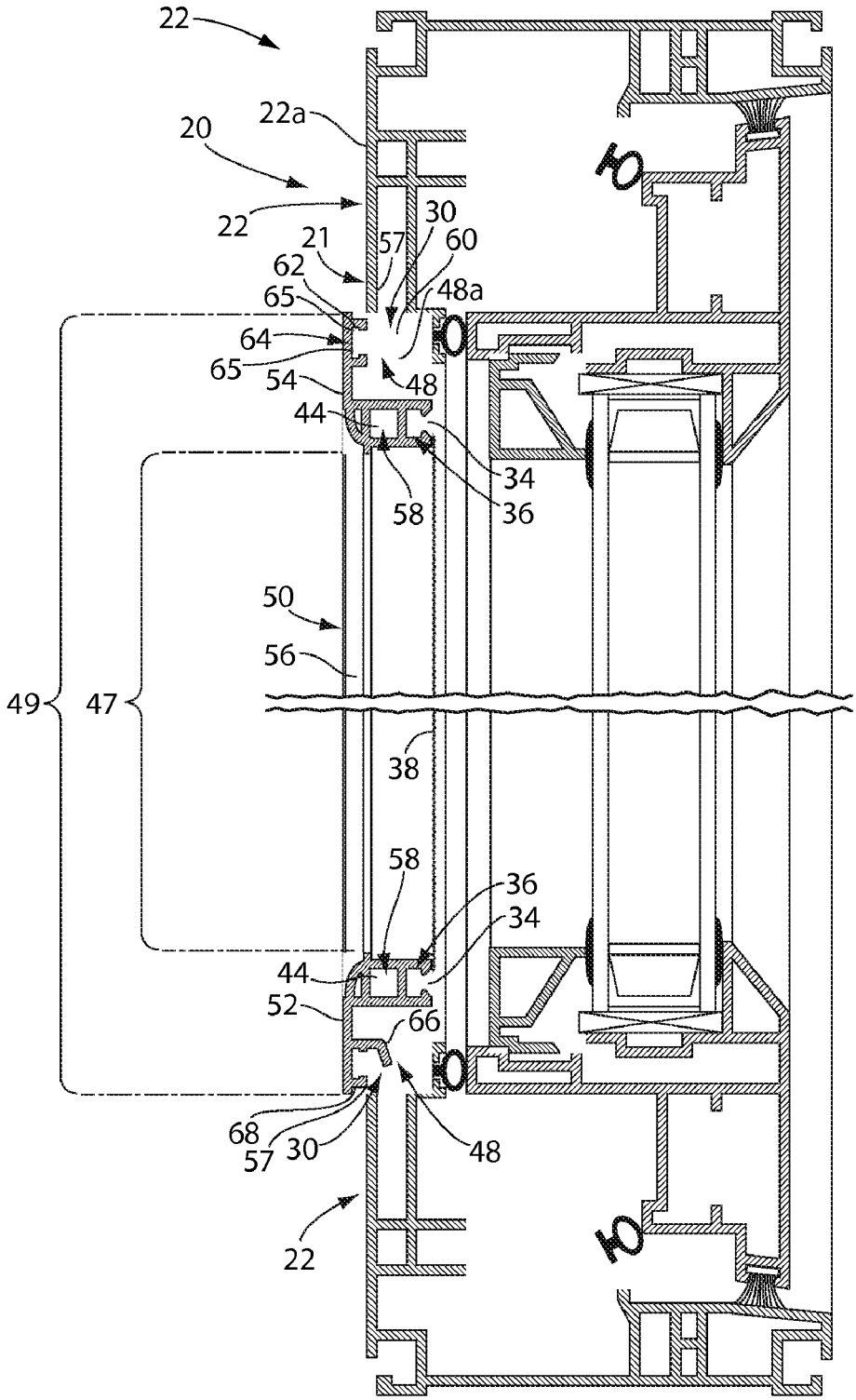
FIG. 3 is a vertical sectional view of a first embodiment of magnetically attachable window screen system.
Figure 4:
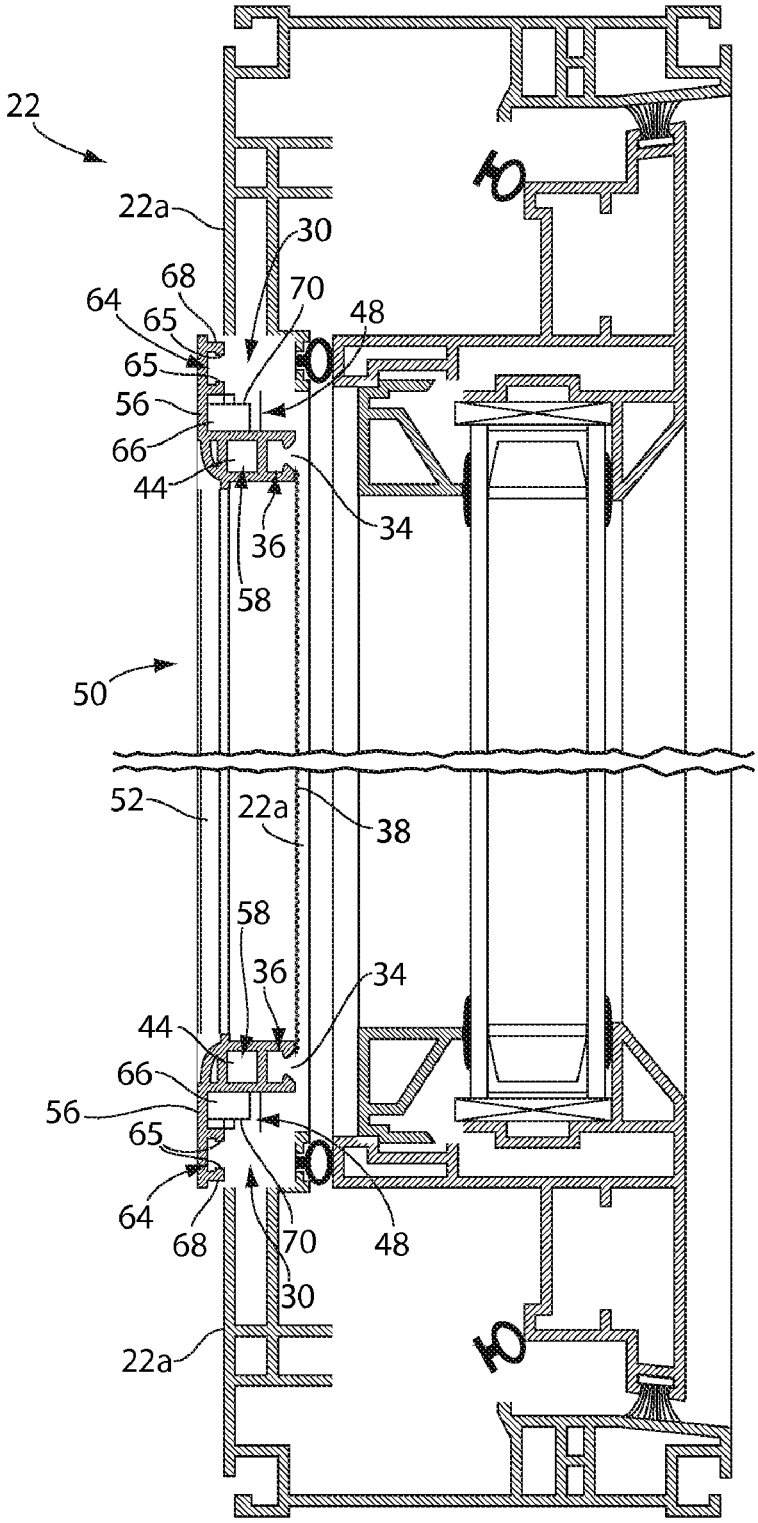
FIG. 4 is a horizontal sectional top view of the first embodiment of the magnetically attachable window screen system.

FIG. 3 is a vertical sectional view of a first embodiment of a magnetically attachable window screen system. Magnetic window screen (with post cavity foot) 50 is for use with prior art window frame 22 which comprises slotted post cavity 30 and post cavity slot 48. Lower horizontal screen bar 52 has a post cavity foot 66 for insertion into slotted post cavity 30 through post cavity slot 48 for supporting the weight of magnetic window screen 50 and thus preventing window screen insert 47 from slipping out of window screen opening 49. Those skilled in the art will recognize that window screen insert 47 need not be between side perimeter walls 23 in this and similar embodiments unless the window screen insert 47 is used to support the window screen. As the side profile of lower horizontal screen bar 52 post cavity foot 66 would typically constitute one long foot running almost the entire length of lower horizontal screen bar 52 as shown in FIG. 4. FIG. 4 shows the ends of post cavity foot 66 which may have to be trimmed to post cavity foot edge 70 in order to ensure that post cavity foot 66 is not wider than the post cavity slot 48 in lower horizontal side 22*a* of window frame 22.

Referring back to FIG. 3, a frame magnet 60 which may be rectangular to fit into slotted post cavity 30 or may be of other profile such as an L shape to fit slotted post cavity and all or a portion of post cavity slot 48, as desired, as shown in FIG. 3. Frame magnets 60 may be inserted in slotted post cavity 30 during manufacture of prior art window frame 22 or may be added to an existing window frame 22 for adapting window frame 22 to be compatible with use with magnetic window screen 50. Frame magnet 60 may be inserted into slotted post cavity 30 in any number of ways, which may include inserting a rectangular or other shaped magnet small enough to fit through post cavity slot 48 and be held in place by gluing for instance. Alternatively, frame magnet 60 may have a width substantially equal to the width of post cavity slot 48 such that frame magnet 60 would be held in place by a friction fit within post cavity slot 48. This method of installation for installing frame magnet 60 can also be supplemented by gluing or other ways known in the art. Alternatively still, post cavity slot lip 48*a* may be trimmed sufficiently to allow a typical rectangular frame magnet 60 to be inserted into slotted post cavity 30 where frame magnet 60 may be held in place by a friction fit within slotted post cavity 30, or by gluing frame magnet 60 within slotted post cavity 30, or both. Alternatively still, frame magnet 60 may be inserted into slotted post cavity 30 where post cavity slot lip 48*a* has been trimmed and frame magnet 60 may be slid further into slotted post cavity 30 where post cavity slot lip 48*a* has not been trimmed. Typically two frame magnets 60 would be installed in the upper horizontal side 22*a* of window frame 22 in spaced apart relationship, one magnet 60 for placement near each of vertical screen bars 56. Thus if post cavity slot lip 48*a* must be trimmed to provide a wider opening, only one opening may be required with any number of frame magnets 60 being slid to their desired location and potentially then held in place by friction, gluing or other means known in the art.

Upper horizontal screen bar 54 and vertical screen bars 56 are typically of identical profile for ease of manufacture. Upper horizontal screen bar 54 comprises screen magnet cavity 64 for inserting one or more screen magnets 62 which are positioned to magnetically cooperate with frame magnets 60 in slotted post cavity 30 for magnetically holding horizontal screen bar 54 against front perimeter wall 21.

Each pair of cooperating frame magnets 60 and screen magnets 62 need to be of sufficient strength to hold together through front perimeter wall 21 of side 22*a* of frame 22. Different sizes and strengths of magnets can be used provided that there is sufficient magnetic cooperation to operate through the thickness of front perimeter wall 21. The size and strength of the magnets required to operate through typical pieces of non-metallic plastic material such as used in casement windows is well known by those skilled in the art. However, at least two neodymium frame magnets 60 approx. 0.2" by 0.2" by 1.25" and at least two co-operating neodymium screen magnets 62 approx. 0.2" by 0.125" by 1.25" have been found to be satisfactory to hold upper horizontal screen bar 54 to upper horizontal side 22*a* of window frame 22 through a front perimeter wall 21 of PVC plastic of between 0.07" to 0.1" thick for a window screen of at least 24" wide by 55" high. Additional magnets may be added in upper horizontal screen bar 54 and slotted post cavity 30 in upper horizontal side 22*a* of frame 22. Additionally, or in the alternative, additional screen magnets 62 may be added to vertical screen bars 56 within screen magnet cavities 64 with corresponding frame magnets 60 in slotted post cavities 30 of vertical sides 22*a* of window frame 22.

Screen magnet cavities 64 may be manufactured with screen magnet cavity flanges 65 for retaining screen magnets 62 within screen magnet cavities 64. T-shaped screen magnets 62 may be slid along screen magnet cavities 64 to the desired locations and secured in place via a friction fit, gluing or other means.

Lower horizontal screen bar (with post cavity foot) 52, upper horizontal screen bar 54 and vertical screen bars 56 also comprise typical gasket cavities 36 for holding screen mesh 38 across window screen insert 47 with screen gaskets 34. Lower horizontal screen bar 52, upper horizontal screen bar 54 and vertical screen bars 56 also include corner key cavities 58 for inserting the ends of corner keys 44 in the ends of screen bars 52, 54, 56 to form rectangular window screen 50. It will also be appreciated by one skilled in the art that although the magnetically attachable window screen system of FIG. 3 has been described with reference to a rectangular casement window 20, lower horizontal screen bar 52 for use in a horizontal slot may be used with three, five or more screen bars (not shown) with corner keys of varying angles other than a perpendicular angle of 90 degrees, to form casement windows of various shapes.

Lower horizontal screen bar 52 also contains screen magnet cavity 64 which is defined by screen magnet cavity spacers 68 in order to ensure that screen bar surface 57 of lower screen bars 52 is the same distance from front perimeter walls 21 as screen bars 54, 56 and to present a uniform appearance around the perimeter of magnetic window screen 50.

FIG. 4 shows vertical screen bars 56 with screen magnet cavities 64 without screen magnets 62 and slotted post cavities 30 of vertical sides 22*a* of frame 22 without frame magnets 60, however magnets 60 and 62 may be used if the height of window screen 50 is high and vertical screen bars 56 bow outwardly from front perimeter walls 21. Screen magnet cavities flanges 65 and screen magnet cavity spacers 68 ensure that the screen bar surfaces 57 of screen bars 56 are of equal distance from front perimeter walls 21 as screen bar surfaces 57 of lower horizontal screen bar 52 and upper horizontal screen bar 54.

Figure 5:
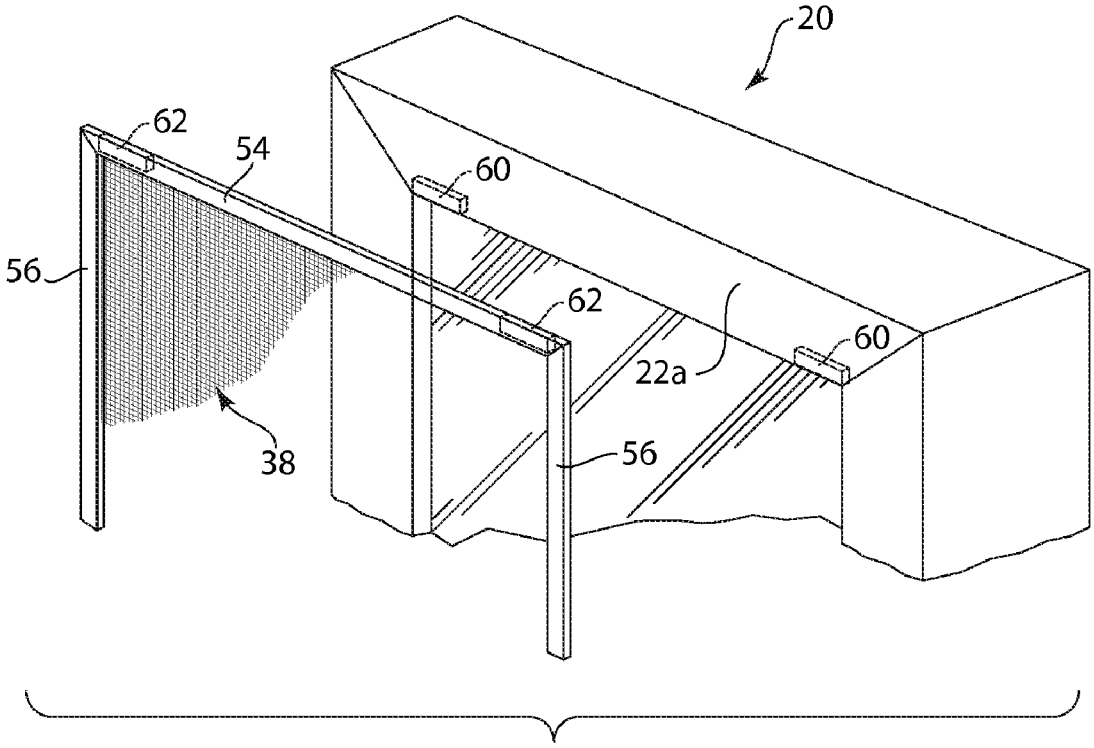
FIG. 5 is an exploded perspective view showing one way to locate the magnets in the first embodiment of the magnetically attachable window screen system.

FIG. 5 shows a window screen and window frame in outline form showing the approximate locations of screen magnets 62 spaced apart from each other in upper horizontal screen bar 54 and frame magnets 60 spaced apart from each other in upper horizontal side 22*a* of window frame 22.

Figure 6:
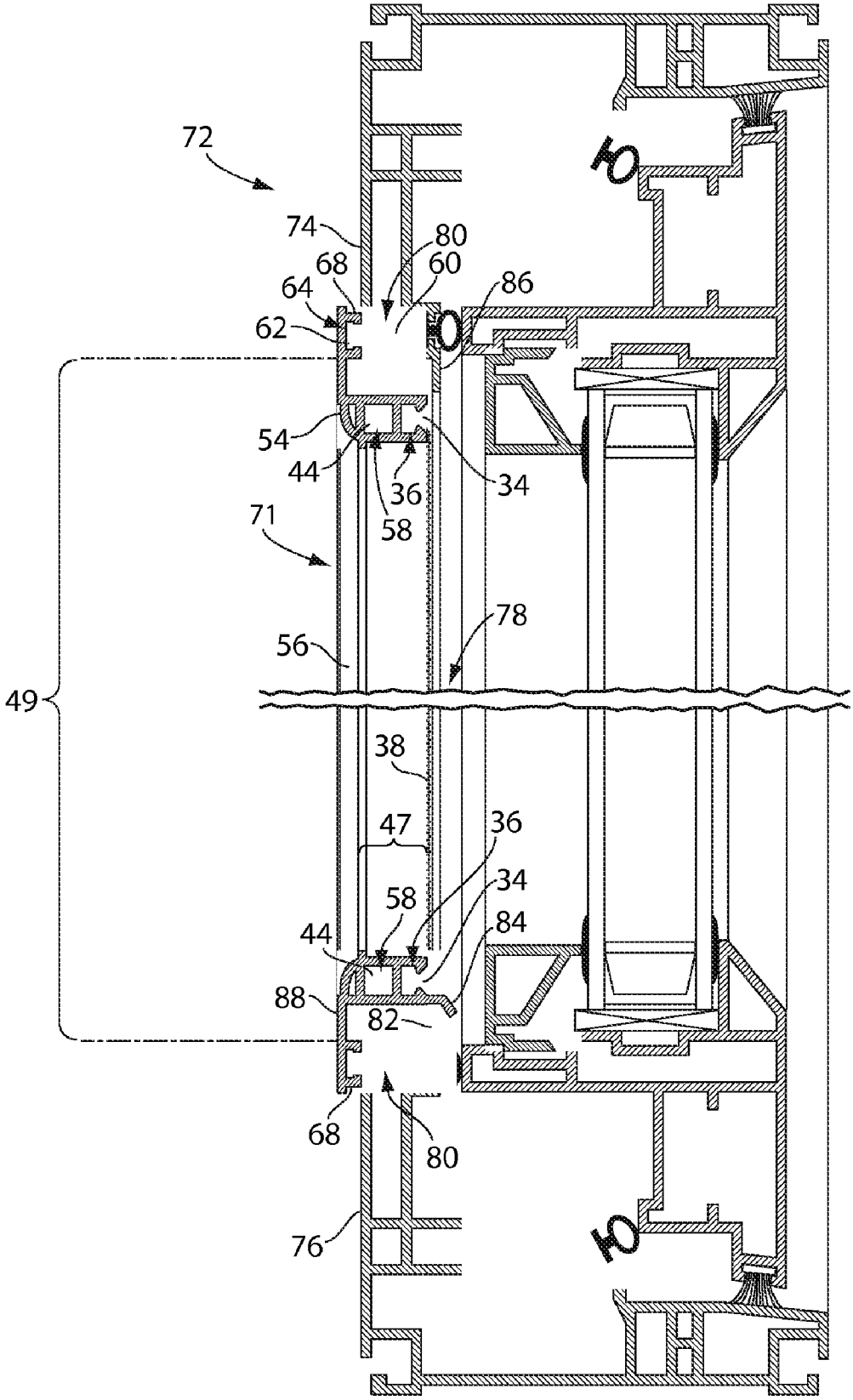
FIG. 6 is a vertical sectional view of a second embodiment of the magnetically attachable window screen system.

FIG. 6 is a second embodiment of the magnetically attachable window screen system similar to the first embodiment except for new window frame (with magnet channel) 72 and new lower horizontal screen bar with lip foot 88. Window frame 72 has a frame magnet cavity 80 with a continuous perimeter without any post cavity slot 48 thus providing an uninterrupted surface along side perimeter walls 23. Dispensing with post cavity slot 48 not only improves the appearance of window frame 72 but also eliminates an entrance for debris to fall into slotted post cavity 30 which is difficult, of not impossible, to completely clean, especially if food and drink falls through post cavity slot 48. Frame magnets 60 which may be of rectangular profile are installed in upper horizontal side 74 of window frame 72 during manufacture. Magnets may be installed in magnet frame cavity 80 in desired positions by using a rod or other pushing device which may be measured. Magnets may again be held in place by a friction fit or by gluing, or by other means known in the art. Frame magnets 60 are preferably attached to the front perimeter wall in this and similar embodiments but need not be so attached as long as Frame magnet 60 is held in sufficient proximity to the front perimeter wall 21 such as by a channel.

Sides 74, 76, 78 of window frame 72 comprise of lips 82, 86. Lower horizontal screen bar 88 includes lip foot 84 for engaging support lip 82 to prevent window screen insert 47 from slipping out of window screen opening 49. Although all sides 74, 76, 78 of window frame 72 comprise the same lip profile only support lip 82 supports any weight of magnetic window screen (with lip foot) 71, decorative lips 86 being used only for consistency of design and so that only one profile of sides 74, 76, 78 is required. Frame magnet cavities 80 in the upper horizontal side 74 of window frame 72 and the vertical sides 78 of window frame 72 are useful for insertion of frame magnets 60 as frame magnet cavity 80 of lower horizontal side 76 of window frame 72 does not require a magnet as lower horizontal screen bar 88 is held in place by lip foot 84 and support lip 82. Similarity, screen magnet cavity 64 and screen magnet cavity spacers 68 of lower horizontal screen bar 88 act only as spacers as a screen magnet 62 is not required in lower horizontal screen bar 88 for the reasons aforesaid.

Figure 7:
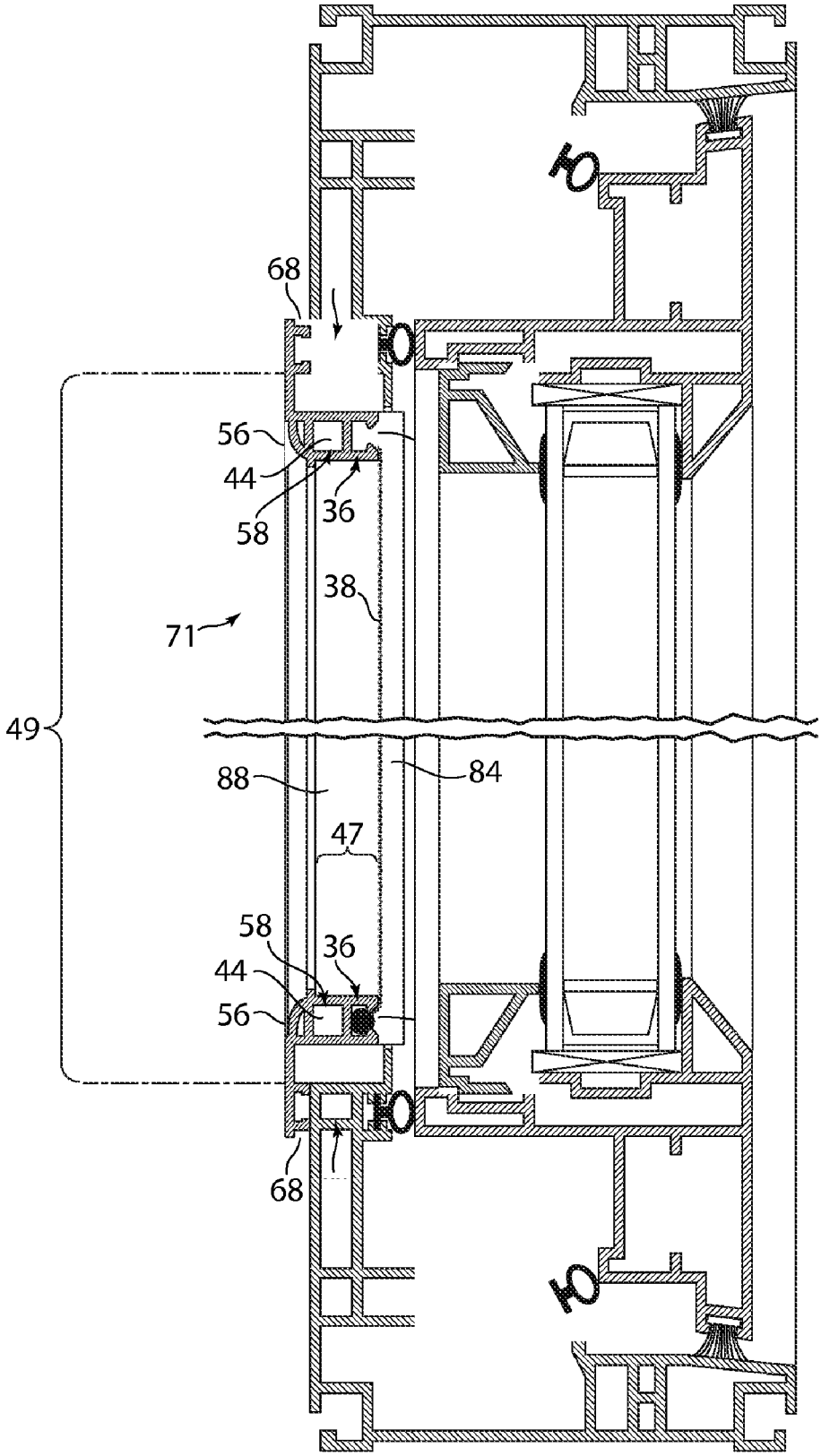
FIG. 7 is a horizontal sectional top view of the second embodiment of the magnetically attachable window screen system.

FIG. 7 is a horizontal sectional top view of the second embodiment of the magnetically attachable window screen system showing lip foot 84 overhanging and engaging support lip 82.

Magnetic window screen 71 also contain corner key cavities 58 for receiving corner keys 44 at the ends of screen bars 54, 56, 88. FIG. 7 also shows a typical gasket cavity 36 for receiving screen gasket 34 for holding screen mesh 38 in place. The sides of screen magnet cavity 64 again act as spacers 68 and may perform this function whether or not screen magnets 62 are inserted in screen magnet cavities 64.

Figure 8:
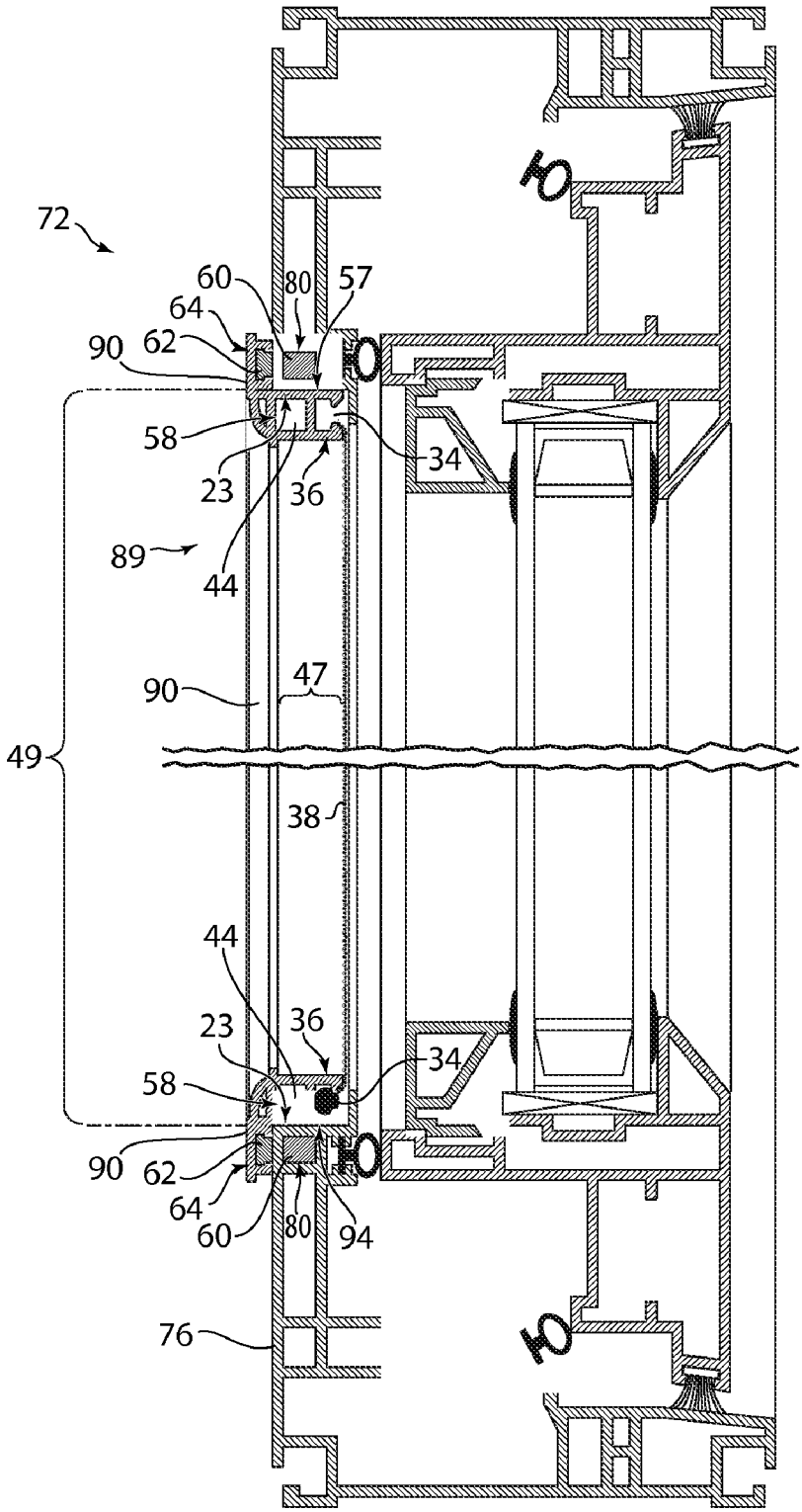
FIG. 8 is a vertical sectional view of a third embodiment of the magnetically attachable screen window screen system.

FIG. 8 is a vertical sectional view of a third embodiment of the magnetically attachable window screen system, showing the window frame 72 of FIGS. 6 and 7, however, lips 82, 86 are not required in this embodiment and treated as decorative only in this third embodiment. Side perimeter wall 23 of lower horizontal side 76 of window frame 72 acts as a ledge for receiving screen frame support surface 94 for supporting the weight of window screen 89. In this embodiment frame magnet cavity 80 is supplied with one or more, usually two, frame magnets 60 which would again be typically installed during manufacture as in the second embodiment. Ledge engaging screen bar 90 includes screen magnet cavity 64 for one or more screen magnets 62 for magnetically cooperating with frame magnet(s) 60 in frame magnet cavity 80. In this embodiment only one profile of screen bar 90 is required, however, magnets 62, 60 are preferred in lower horizontal screen bar 90 and lower horizontal side 76 as lower horizontal screen bar 90 contains no non-magnetic means for holding window screen insert 47 in window screen opening 49. This embodiment would often include only two pair of cooperating magnets 62, 60 in upper horizontal cavities 64, 80 and two pair of cooperating magnets 62, 60 in lower horizontal cavities 64, 80.

However, it will be understood to those skilled in the art that as screen bars 90 are substantially rigid window screen 89 may be securely held in place by as little one pair of co-operating magnets 62, 60 in co-operating cavities 64, 80 in at least two sides of the window frame 72 and window screen 89. However, if magnets are to be used on only two of sides 74, 76, 78, opposing sides are recommended. Opposing sides would usually be substantially parallel for a rectangular window. Although parallel screen bars 90 may be either horizontal or vertical, horizontal screen bars 90 would be more common.

Figure 9:
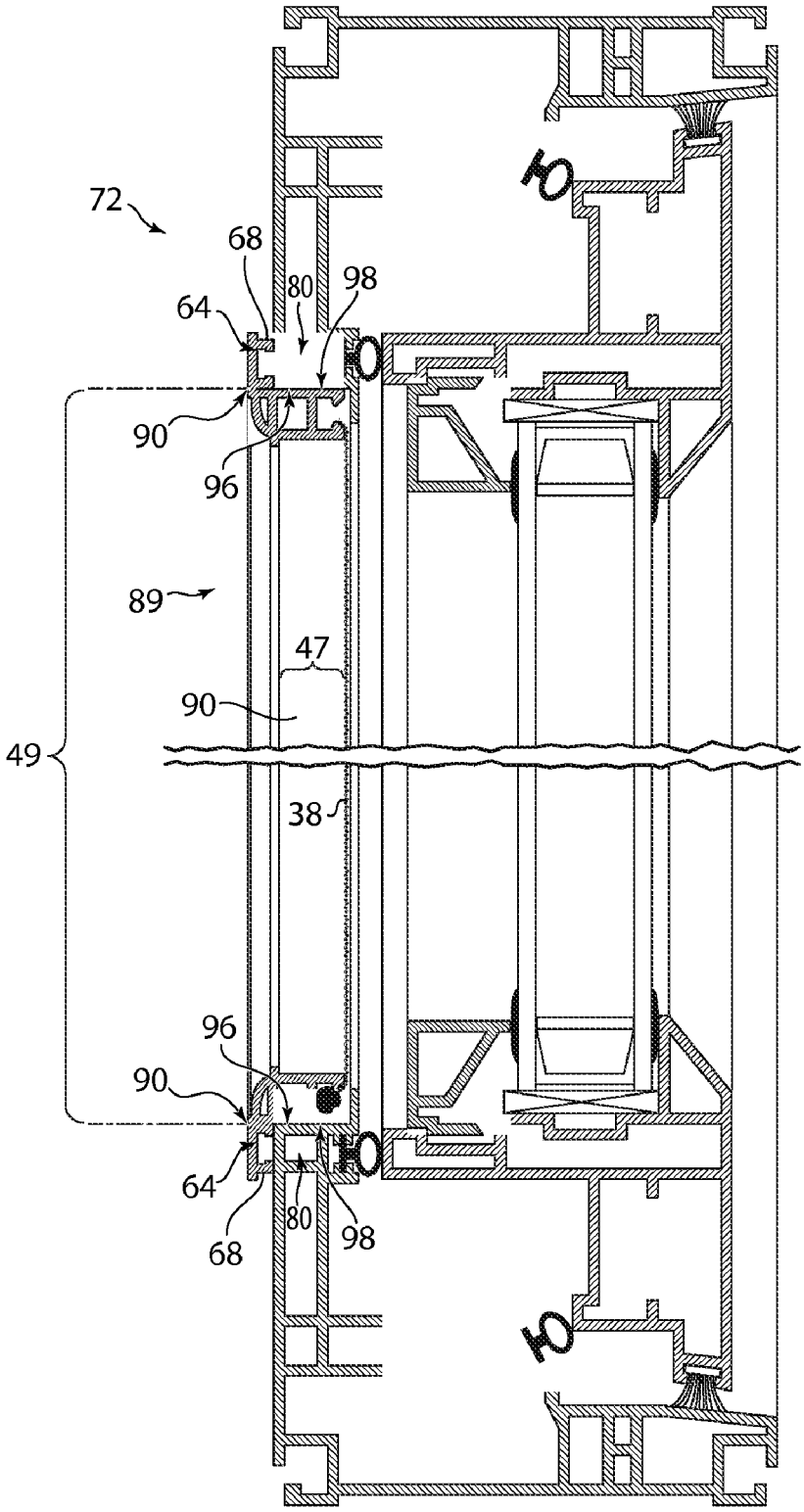
FIG. 9 is a horizontal sectional top view of the third embodiment of the magnetically attachable window screen system.

FIG. 9 is a horizontal sectional top view of the third embodiment of the magnetically attachable window screen system showing vertical screen bars 90 with screen magnet cavities 64 without magnets 62 therein and vertical frame magnet cavities 80 without magnets 60 therein. As previously recited magnets 62, 60 may be used within vertical cavities 64, 80 respectively if extra strength is required or to prevent bowing of screen bars 90. The height and width of window screen insert 47 of window screen 89 are slightly smaller than the height and width of window screen opening 49 of window frame 72 to prevent binding in the event of minor expansion of window parts.

In embodiments one to three aforementioned screen magnets 62 in screen magnet cavities 64 mounted against front perimeter walls 21 co-operate with corresponding frame magnets in a substantially horizontal manner. In the fourth, fifth and sixth embodiments described for below the magnets within the screen bars and magnets within the window frames co-operate substantially parallel to the plane (not shown) along front perimeter walls 21. It will be understood by those skilled in the art that other shapes and locations of magnets will serve the same purpose and that the forces of magnetism need not necessarily operate horizontally or parallel to said plane.

Figure 10:
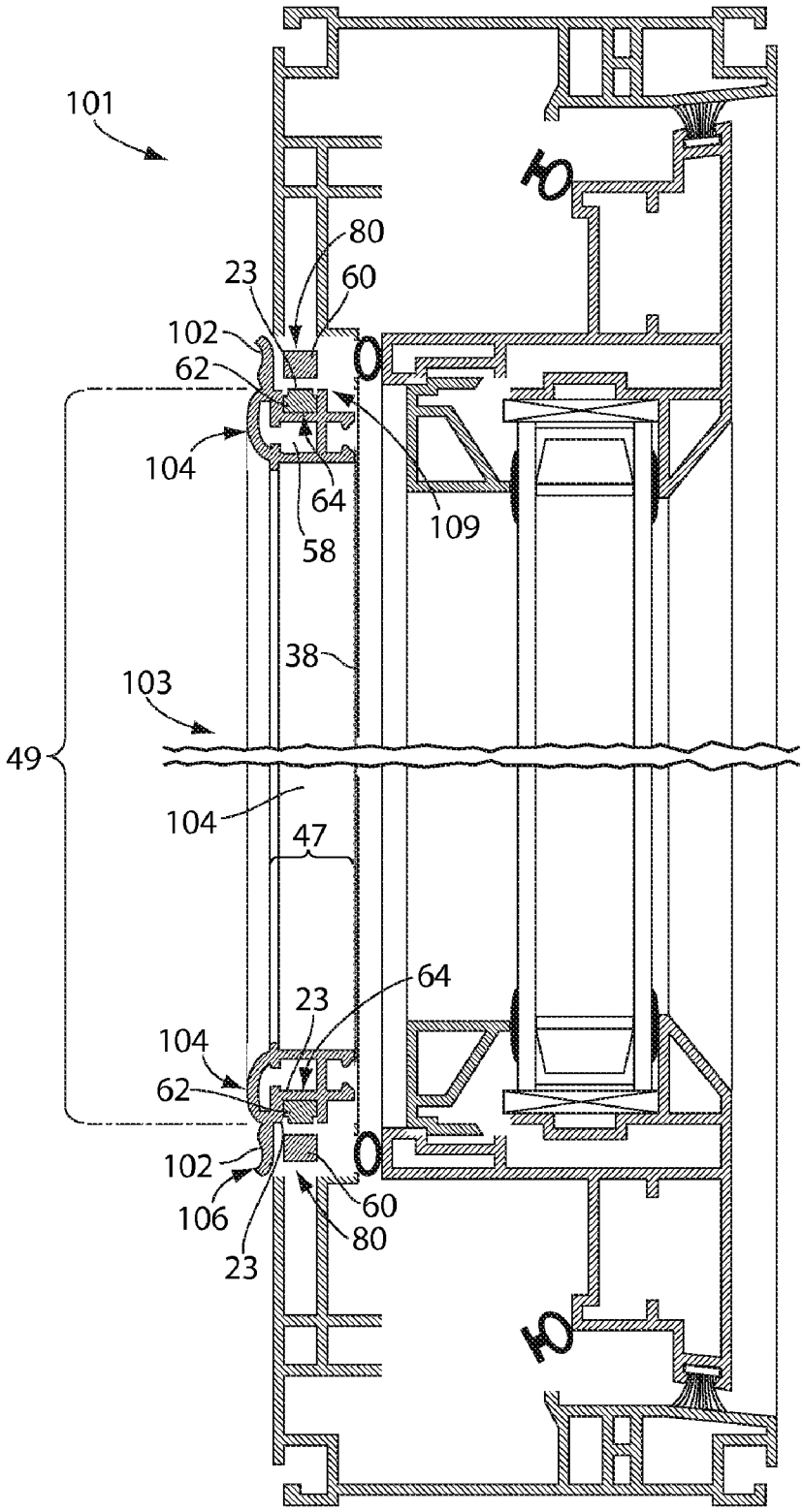
FIG. 10 is a vertical sectional view of a fourth embodiment of the magnetically attachable window screen system.
Figure 11:
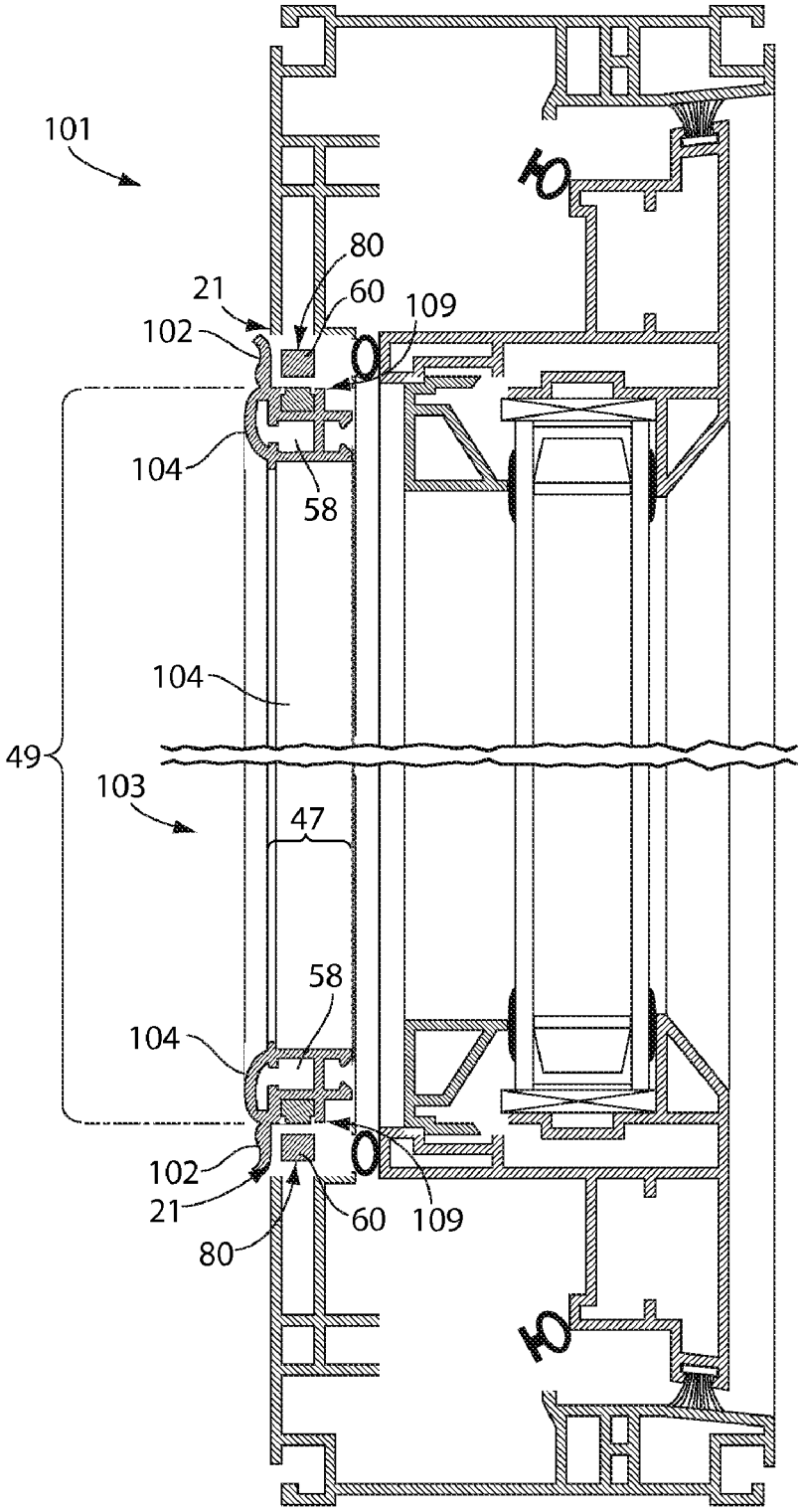
FIG. 11 is a horizontal sectional top view of the fourth embodiment of the magnetically attachable window screen system.
Figure 12:
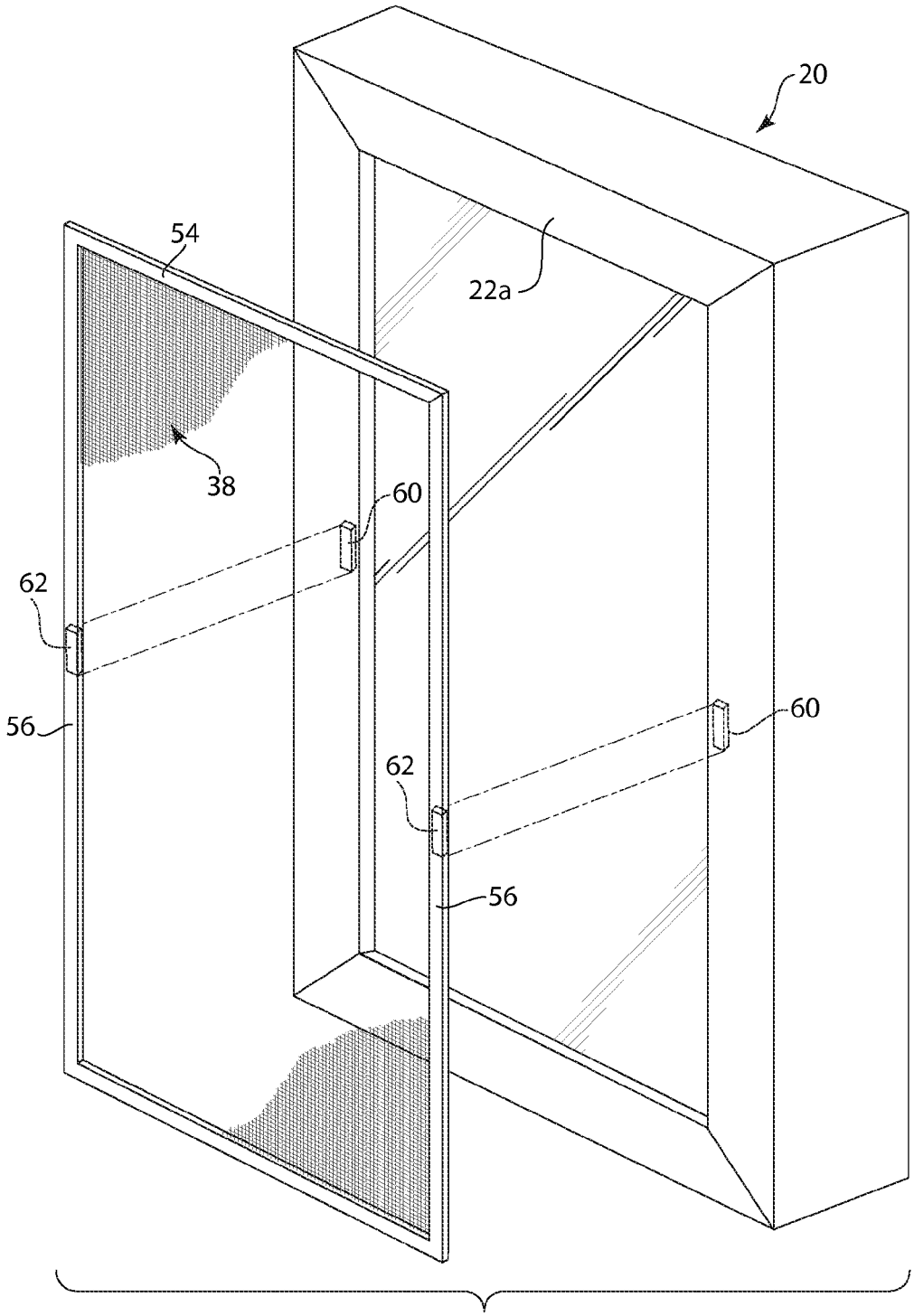
FIG. 12 is an exploded perspective view of one way to locate additional magnets in the magnetically attachable window screen system.

FIG. 10 is a fourth embodiment of the magnetically attachable window screen system 100. Window frame 101 is substantially the same as window frame 72 of the second embodiment shown in FIGS. 5 and 6 and the third embodiment shown in FIGS. 8 and 9, except that window frame 101 does not include lips 82-86. Window frame 101 is also contemplated for use with the third embodiment shown in FIGS. 8 and 9, as lips are not required in the third embodiment. FIG. 10 is a vertical sectional view of the fourth embodiment of the magnetically attachable window screen system 100. FIGS. 10 and 11 show identical screen bars 104 comprising each of the four sides of the window screen 103. FIG. 10 show screen magnet 62, of lower horizontal screen bar 104 resting on side perimeter wall 23 of lower horizontal side of window frame 101. Screen bars 104 comprise screen magnet cavities 64 arranged to butt or overlay side perimeter walls 23. Screen magnets 62 of screen magnet cavity 64 of horizontal screen bar 104 rests on the side perimeter wall 23 of the lower horizontal side of window frame 101 which magnets 62 magnetically cooperates with frame magnets 60 in frame magnet cavity 80. Frame magnets 60 are preferably attached to the side perimeter wall in this and similar embodiments but need not be so attached as long as Frame magnet 60 is held in sufficient proximity to the side perimeter wall 21 such as by a. Magnets 62 and 60 are also used in screen magnet cavity 64 in upper horizontal screen bar 104 and frame magnet cavity 80 of upper horizontal side of window frame 101. In this embodiment, and the fifth and sixth embodiments described hereafter, there will typically be a small gap 109 between screen magnet 62 in upper horizontal screen bar 104 and side perimeter wall 23 of upper horizontal side of window frame 101 unless window screen insert 47 is sized to fit window screen window opening 49 in a substantially friction fit manner which would usually not be done in order to avoid scratching the window frame 101 and to aid with easy removal of window screen 103 from window frame 101. Accordingly, gap 109 is preferably as possible in order to maximize the magnetic attraction between magnets 62, 60 which are aligned substantially laterally. FIG. 11 is a horizontal sectional top view of the fourth embodiment of the magnetically attachable window screen system 100 with gaps 109 (not shown) between screen magnets 62 of vertical screen bars 104 and the vertical sides of window frame 101 depending upon how window screen insert 47 is installed in window screen opening 49 one of the screen magnets 62 in screen magnet cavity 64 of vertical screen bars 104 may abut one of the side perimeter walls 23 of one of the sides of window frame 101 but magnets 62 will not abut the side perimeter walls 23 of both vertical sides of window frame 101 unless a friction fit is desired for some reason. Accordingly, the gap between at least one of magnets 62 and one of side perimeter walls 23 should be as little as possible in order to maximize magnetic attraction. As at least two adjacent sides of window screen insert 47 are not intended to abut the sides of window screen opening 49, FIGS. 10 and 11 show magnets 62 in both vertical and horizontal screen bars 104 with cooperating magnets in corresponding frame magnet cavities 80 of window frame 101 in order to more securely hold the window screen place.

FIGS. 10 and 11 show mounting flanges 102 which when pressed against front perimeter walls 21 align corresponding magnets 62 and 60. FIGS. 10 and 11 show corner key cavities 58 in screen bars 104 for use with corner keys 44. Screen bars 104 also contain gasket cavities 36 for positioning screen mesh 38 across window screen insert 47 with screen gaskets 34.

Figure 13:
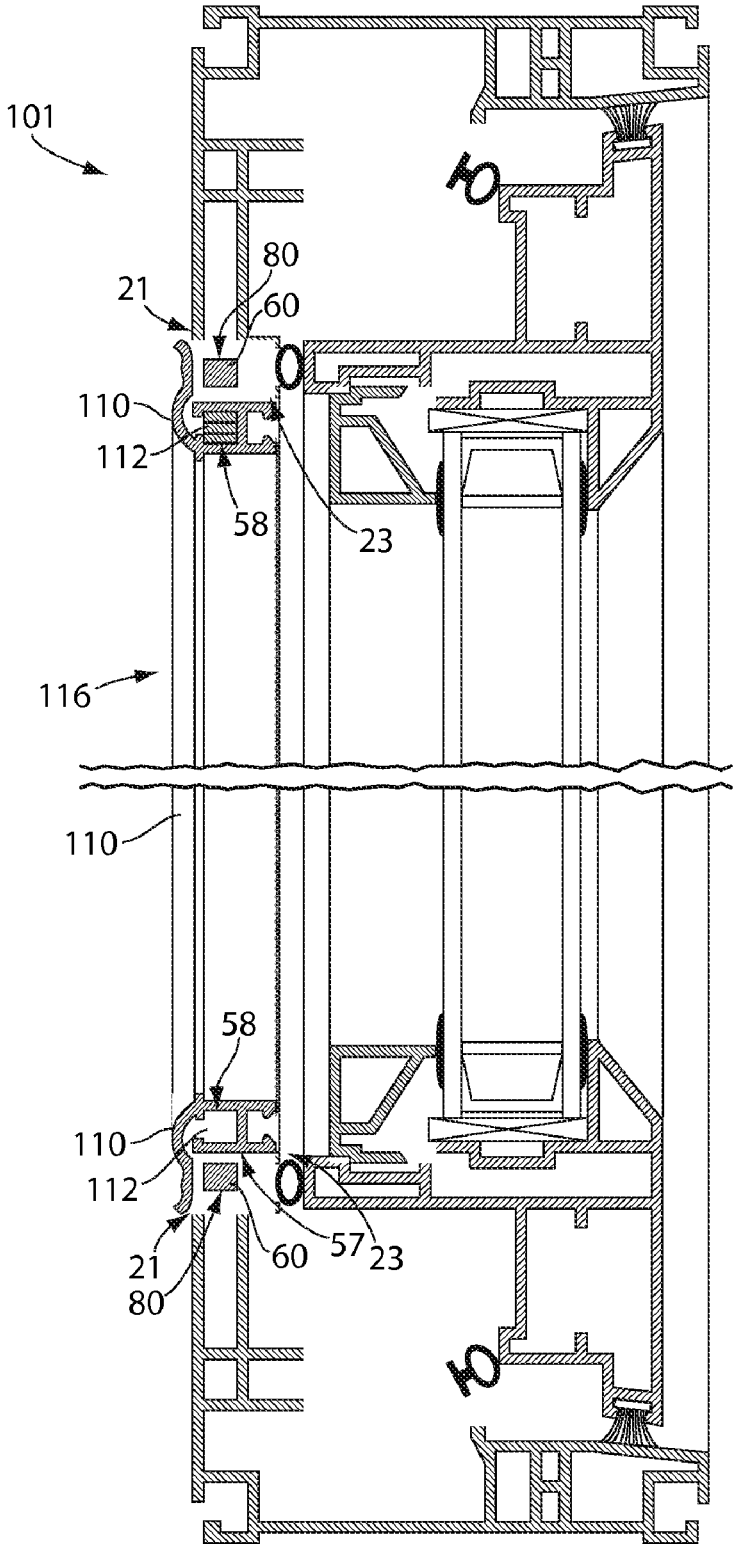
FIG. 13 is a vertical sectional view of a fifth embodiment of the magnetically attachable window screen system.

FIG. 13 shows a vertical sectional side view of a fifth embodiment of the magnetically attachable window screen system 120 using window frame 101 of the fourth embodiment shown in FIGS. 10 and 11. FIG. 13 shows screen bars 110 which are the same for all four sides of window screen 116. Screen bars 110 omit separate screen magnet cavities 64 of other figures and use corner key cavities 58 for receiving one or more screen magnets 112 for laterally co-operating with frame magnets 60.

As in FIG. 8, screen bar surface 57 rests upon side perimeter wall 23 of lower horizontal side of window frame 101 by means of gravity.

Figure 14:
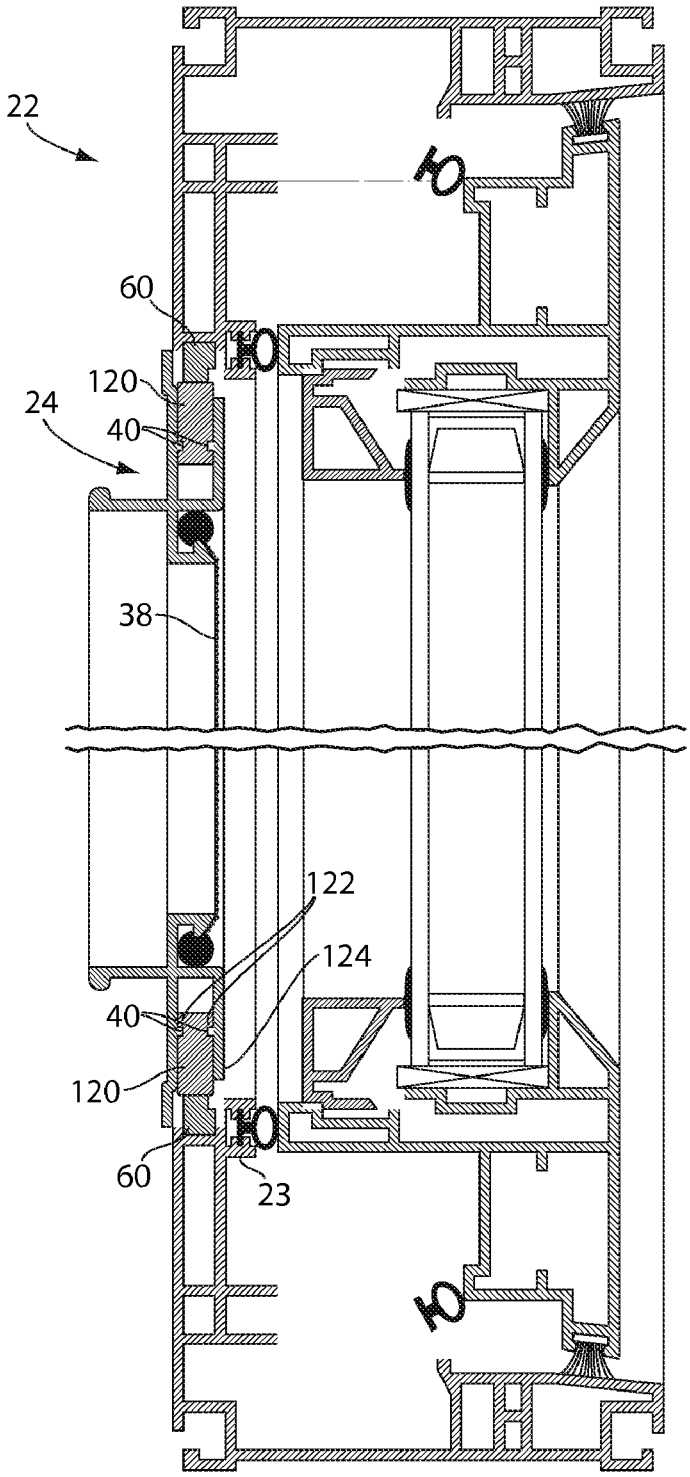
FIG. 14 is a vertical sectional view of a sixth embodiment of the magnetically attachable window screen system.

FIG. 14 is a vertical sectional view of a sixth embodiment of the magnetically attachable window screen system in which the prior art window screen 24 of FIG. 1 is modified by installing H shaped screen magnets 120 having slots 122 in opposing sides of magnets 120 for installing in U shaped chamber 45 along retaining ribs 40, which H shaped magnets may be held in place by a friction fit, gluing, crimping or other ways known in the trade. Crimping may be used in other embodiments as well. Screen frame 24 is held in position in substantially the same manner as embodiments four and five, except that magnet 120 need not rest on magnet 60 or side perimeter wall 23. Magnets 122 may be mounted further into U shaped chamber and support leg 124 of window screen 24 may rest on side perimeter wall or on magnet 60.

It will be understood by those skilled in the art that the above disclosure is directed primarily to specific embodiments of the present invention and that the subject invention is susceptible of reduction to practice in other embodiments that fall within the scope of the invention and the appended claims.

PARTS LIST

20. casement window
21. front perimeter wall
22. window frame (prior art)
22*a*. window frame side
23. Side perimeter wall
24. window screen
25. screen bar
26. retractable posts
26*a*. ends (of biased retractable posts)
27. perimeter walls
28. pull tab
29. frame perimeter corner
30. slotted post cavity
32. slotted corner key cavity
34. screen gasket
36. gasket cavity
38. screen mesh
40. retaining rib
40*a*. inside edge (of retaining rib)
41. retaining rib slot
42. post passage
44. corner keys
45. generally U-shaped chamber
45*a*. interior chamber side walls
46. retaining clips
47. window screen insert
48. post cavity slots
48*a*. post cavity slot lip
49. window screen opening
50. magnetic window screen with post cavity foot
52. lower horizontal screen bar with post cavity foot
54. upper horizontal screen bar
56. vertical screen bar
57. screen bar surface
58. corner key cavity
60. frame magnet
62. screen magnet
64. screen magnet cavity
65. screen magnet cavity flanges
66. post cavity foot
68. screen magnet cavity spacer
70. post cavity foot edge
71. magnetic window screen with lip foot
72. window frame (with magnet channel)
74. upper horizontal side (of window frame)
76. lower horizontal side (of window frame)
78. vertical side (of window frame)
80. frame magnet cavity
82. support lip
84. lip foot
86. decorative lip
88. lower horizontal screen bar with lip foot
89. window screen (of third embodiment)
90. screen bar
92. window frame support ledge
94. screen frame support surface
96. screen bar side wall
98. window screen opening side wall
101. window frame (without lips)
102. mounting flanges
103. window screen
104. screen bars
109. small gap
110. screen bars
112. screen magnets
116. window screen
120. H shaped magnets
122. slots in opposing sides (of H shaped magnets)
124. support leg.

The invention claimed is:

1. A magnetically attachable window screen system comprising, a rectangular casement window comprising a casement window frame for removably attaching a rectangular window screen, the casement window frame comprising four window frame sides, the four window frame sides comprising a lower horizontal frame side, an upper horizontal frame side and two opposing vertical frame sides, each window frame side comprising a front perimeter wall and a side perimeter wall, at least one frame magnet fitted in a cavity in a corresponding at least one of the window frame sides of the casement window frame at least partly behind one of the plane defining the front perimeter wall and the plane defining the side perimeter wall, at least one support on the casement window frame for supporting the window screen, the window screen comprising a screen frame comprising four screen bars, the four screen bars comprising a lower horizontal screen bar, an upper horizontal screen bar, and two vertical screen bars, the window screen further comprising a support engaging surface for receiving the support on the casement window frame, the window screen further comprising at least one screen magnet inserted into a screen magnet cavity in a corresponding one of the screen bars of the window screen frame and positioned to magnetically co-operate with the at least one frame magnet fitted in the cavity in the corresponding at least one of the window frame sides of the casement window frame through at least a thickness of the at least one of the plane defining the front perimeter wall and the plane defining the side perimeter wall.

2. The magnetically attachable window screen system of claim 1 wherein the at least one frame magnet is attached to the front perimeter wall or the side perimeter wall or both the front perimeter wall and side perimeter wall.

3. The magnetically attachable window screen system of claim 2 wherein the at least one frame magnet is in a channel within the casement window frame and attached to a back of the front perimeter wall, a back of the side perimeter wall or a back of both the front perimeter wall and the side perimeter wall.

4. The magnetically attachable window screen system of claim 3 wherein the channel is sized to locate the at least one frame magnet against the front perimeter wall, or the side perimeter wall or both the front perimeter wall and side perimeter wall.

5. The magnetically attachable window screen system of claim 4 wherein the at least one magnet is held in a fixed position in the channel by a friction fit.

6. The magnetically attachable window screen system of claims 5 wherein the at least one magnet is made of neodymium.

7. The magnetically attachable window screen system of claim 6 wherein the at least one frame magnet is covered by the front perimeter wall and side perimeter wall whereby the at least one magnet is invisible from the outside of the casement window frame.

8. The magnetically attachable window screen system of claim 1 wherein the at least one frame magnet is visible from the outside of the casement window frame.

9. The magnetically attachable window screen system of claim 1 wherein the at least one frame magnet is attached to the front perimeter wall of one or more of the window frame sides for magnetic co-operation through at least one front perimeter wall with one or more corresponding screen magnets attached to one or more screen bars and positioned to substantially abut the at least one front perimeter wall of one or more frame sides horizontally opposite the corresponding frame magnet.

10. The magnetically attachable window screen system of claim 1 wherein the at least one frame magnet is attached to the side perimeter wall of one or more of the window frame sides for magnetic co-operation through at least one side perimeter wall with one or more corresponding screen magnets attached to one or more screen bars and positioned to substantially abut the at least one side perimeter wall of one or more frame sides laterally opposite the corresponding frame magnet.

11. The magnetically attachable window screen system of claim 1 wherein the at least one frame magnet is attached to the front perimeter wall and the side perimeter wall at substantially their point of intersection of one or more of the window frame sides for magnetic co-operation through at least one front perimeter wall with one or more corresponding screen magnets attached to one or more screen bars and positioned to substantially abut the front perimeter wall of one or more window frame sides horizontally opposite the corresponding frame magnet, or for magnetic co-operation through at least one side perimeter wall with one or more corresponding screen magnets attached to one or more screen bars and positioned to substantially abut the side perimeter wall of one or more window frame sides laterally opposite the corresponding frame magnet.

12. The magnetically attachable window screen system of claim 4 wherein the at least one support on the casement window frame comprises one or more longitudinal slots in the side perimeter wall of the lower horizontal frame side for receiving one or more co-operating foot attached to the lower horizontal screen bar of the screen frame.

13. The magnetically attachable window screen system of claim 4 wherein the at least one support on the casement window frame comprises one or more lip along the lower horizontal frame side for receiving one or more co-operating foot attached to the lower horizontal screen bar of the screen frame.

14. The magnetically attachable window screen system of claim 4 wherein the side perimeter wall of the lower horizontal frame side comprises the at least one support on the casement window frame.

15. The magnetically attachable window screen system of claim 4 wherein the at least one support on the casement window frame comprises one or more frame magnets attached to the front perimeter wall or the side perimeter wall or both the front perimeter wall and the side perimeter wall of the lower horizontal frame side for magnetic co-operation with one or more screen magnets attached to the lower horizontal screen bar.

16. The magnetically attachable window screen system of claim 12 wherein the at least one frame magnet comprises two frame magnets attached to the upper horizontal frame side in spaced apart relationship and the at least one screen magnets comprise two screen magnets attached to the upper horizontal screen bar in spaced apart relationship for magnetic co-operation between each pair of frame magnet and screen magnet.

17. The magnetically attachable window screen system of claim 12 wherein the at least one frame magnet comprises at least two opposing frame magnets, one frame magnet attached to each of the two vertical window frame sides proximate the upper horizontal frame side.

18. A magnetically attachable window screen system comprising:

a casement window comprising a window frame comprising at least three frame sides defining;

a window screen comprising a screen frame comprising the same number of sides as the window frame;

the window screen sized to cover the window opening;

at least one frame magnet fitted in a cavity within a corresponding at least one of the window frame sides of the window frame;

the screen frame comprising at least one screen magnet inserted into a screen magnet cavity in a corresponding one of the screen sides of the screen frame; and the at least one frame magnet and the at least one screen magnet comprising at least one pair of magnets arranged to magnetically co-operate with each other through at least a thickness of at least one of walls of the corresponding at least one of the window frame sides having the cavity into which the at least one frame magnet is fitted for removably holding the window screen against the window frame.

19. The system of claim 18 wherein each of the at least one frame magnet within the window frame is mounted in a channel within any of the frame sides.

20. The system of claim 19 wherein a wall of the channel is defined by an inner surface of a perimeter wall of the frame side.

21. The system of claim 20 wherein the perimeter wall further comprises a front perimeter wall and a side perimeter wall.

22. The system of claim 21 wherein the inner surface of the perimeter wall comprising an inner surface of the front perimeter wall.

23. The system of claim 21 wherein the inner surface of the perimeter wall comprises an inner surface of the side perimeter wall.

24. The system of claim 21 wherein one wall of the channel deferred by the inner surface of the perimeter wall comprises an inner surface of the front perimeter wall and another wall at the of the channel deferred by the inner surface of the perimeter wall comprises an inner surface of the side perimeter wall.

* * * * *